United States Patent [19]

Potter

[11] Patent Number: 4,571,238

[45] Date of Patent: Feb. 18, 1986

[54] CENTRIFUGE ROTOR HAVING A RETAINING ARRANGEMENT THEREON

[75] Inventor: Raymond G. Potter, Southbury, Conn.

[73] Assignee: E. I. Du Pont de Nemours and Company, Wilmington, Del.

[21] Appl. No.: 530,653

[22] Filed: Sep. 9, 1983

[51] Int. Cl.[4] ..... B04B 5/02

[52] U.S. Cl. ..... 494/12; 494/16

[58] Field of Search ..... 422/72, 101; 494/12, 494/16, 17, 18, 19, 20, 21, 60, 84

[56] References Cited

U.S. PATENT DOCUMENTS

| | | | |
|---|---|---|---|
| 3,050,239 | 8/1962 | Williams, Jr. | 233/24 |
| 3,891,140 | 6/1975 | Ayres | 494/16 |
| 4,341,342 | 7/1982 | Hara | 233/1 A |
| 4,375,272 | 5/1983 | Sutton | 494/16 |

*Primary Examiner*—Robert W. Jenkins
*Assistant Examiner*—Arthur D. Dahlberg

[57] ABSTRACT

A rotor for a centrifuge is provided with a peripheral groove having confronting slots communicating therewith. A retaining member is disposed so as to overlie each of the slots by a predetermined radial distance. The radial dimension of each slot is greater than the sum of the radial distance by which the retaining member overlies the slot and the radial thickness dimension of a tube carrier receivable within the slots. Thus, the tube carrier is movable within the slots from a first, radially inner, position to a second radially outer, position in response to centrifugal force such that when in the second position movement of the tube carrier in a direction parallel to the axis of rotation is prohibited.

16 Claims, 5 Drawing Figures

CENTRIFUGE ROTOR HAVING A RETAINING ARRANGEMENT THEREON

BACKGROUND OF THE INVENTION

Field of the Invention

This invention relates to centrifuge apparatus and, in particular, to a centrifuge rotor having a retaining arrangement thereon which prevents the escape of a tube carrier from the rotor.

Centrifuge apparatus are known which are adapted especially for the centrifugation of samples of material carried in test tubes or in small capped, plastic vials known as micro test tubes or microtubes. Exemplary of such apparatus are those described in U.S. Pat. Nos. 4,375,272 (Sutton), 4,341,342 (Hara), 4,306,676 (Edwards et al.) and 3,059,239 (Williams). The last-mentioned Williams patent discloses a generally cylindrical rotor body having angularly adjacent arms which cooperate to define peripheral grooves. The grooves extend generally parallel to the rotor'Is axis of rotation. Confronting faces on the arms are provided with slots which enable each of the peripheral grooves to receive and support a tube carrier. In the Williams patent each tube carrier is an elongated rectangular member having an array of appertures arranged therein. The appertures are sized to receive and to hold a corresponding plurality of microtubes. When a loaded tube carrier is inserted into confronting peripheral slots on the rotor, the carrier is edgewise supported in the groove such that the axis of each tube carried by the carrier extends substantially radially outwardly with respect to the body of the rotor.

It is possible that during centrifugation individual ones of the tubes carried on a tube carrier may burst. As a result the rotor may become unbalanced and wobble about its axis of rotation. Such an occurrence has been observed to impose lifting forces on the tube carriers supported within the peripheral grooves of the rotor. The carriers, therefore, have a tendency to be lifted up and out of the peripheral grooves in the rotor. In extreme cases centrifugal force effects have been observed literally to bend the uplifted portion of the tube carrier radially outwardly.

In view of the foregoing, it is believed advantageous to provide a retaining arrangement for a centrifuge rotor which will effectively prevent the escape of a tube carrier from a peripheral groove formed in the rotor body in the event of rotor unbalance.

SUMMARY OF THE INVENTION

This invention relates to a rotor for a centrifuge adapted to spin samples of material in tubes, such as, for example, the tubes known as micro test tubes or microtubes. The tubes are carried in a tube carrier receivable within the rotor. In general, the invention relates to a rotor having a retaining member arranged so as to prohibit movement of the tube carrier in a direction parallel to the axis of the rotor.

The rotor is provided with a plurality of radially extending arms disposed about the periphery of the rotor body. Angularly adjacent ones of the arms cooperate to define a plurality of grooves, the vertical axis of each of which extends generally parallel to the axis of rotation of the rotor. Each arm extends in a generally radial direction and is provided with lateral faces. Each face of such arms has a slot which communicates with the groove to which it is adjacent. The axis of each slot is substantially parallel to the rotor's axis of rotation. Further, each slot has a predetermined dimension measured in a substantially radial direction of the rotor. The lower end of each slot is suitably closed, as by a plate attached under the bottom surface of the rotor. Angularly confronting ones of the slots cooperate with each other to receive and to edgewise support the tube carrier. Each tube carrier has a generally elongated flange having a predetermined thickness dimension measurable in a substantially radial direction of the rotor.

In accordance with this invention, a retaining member in the form of an overhanging lip is provided on the radially outer edge of the rotor body in the vicinity of at least one but preferably both of the slots communicating with each peripheral groove. Each retaining lip overlies the upper portion, or mouth, of the slot with which it is associated by a predetermined distance measured radially with respect to the rotor. The radial dimension of each slot is greater than the sum of the radial distance by which the retaining member overlies its associated slot and the radial thickness dimension of the portion of the tube carrier receivable within the slot. The tube carrier is thus movable within the slots in response to centrifugal force from a first, radially inner, to a second, radially outer, position in which a portion of the tube carrier lies beneath the retaining lip whereby movement of the tube carrier in the slots in a direction parallel to the axis of rotation of the rotor is prohibited by the retaining lips.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
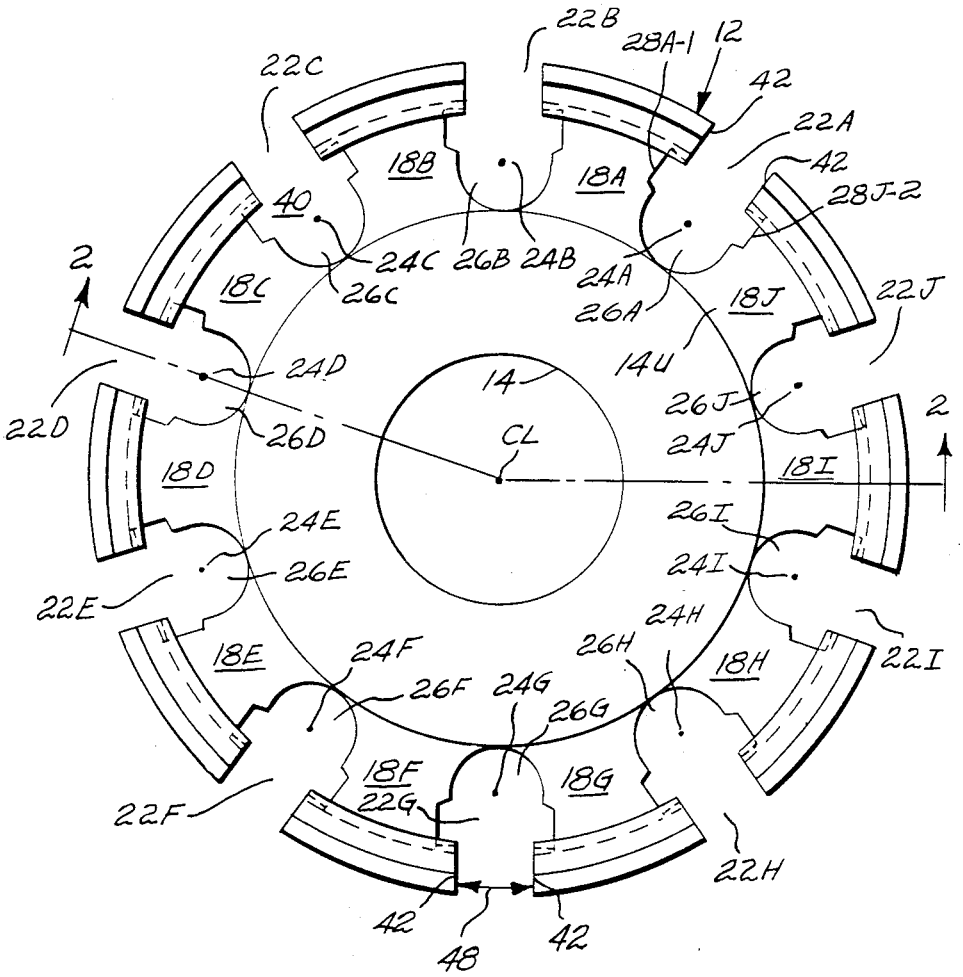
FIG. 1 is a plan view of a centrifuge rotor which includes a tube carrier retaining member in accordance with the present invention.

Throughout the following detailed description similar reference numerals refer to similar elements in all figures of the drawings.

Figure 2:
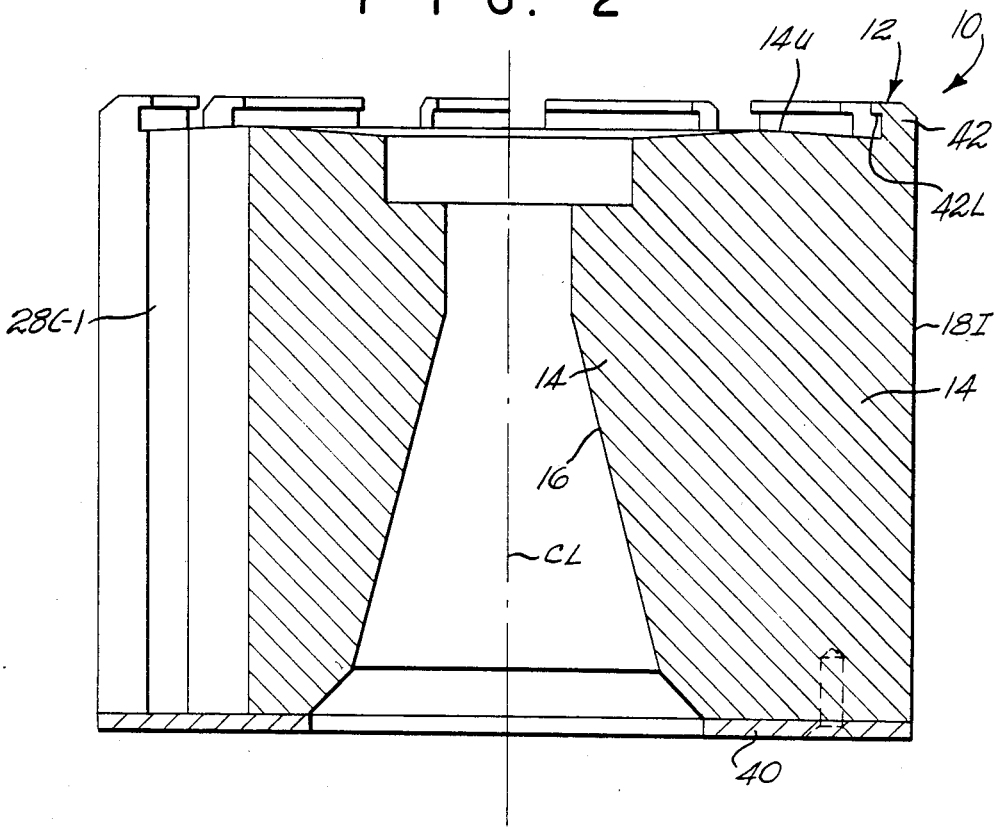
FIG. 2 is a sectional view taken along section lines 2—2 in FIG. 1.

With reference to FIGS. 1 and 2 shown is a centrifuge rotor indicated by reference character 10 with which a retaining arrangement generally indicated by reference character 12 may be used. The rotor 10 is adapted to spin a sample of a material contained within tubes, particularly those tubes known as micro test tubes or microtubes. It should be noted that the teachings of this invention may be applied to the centrifugation of material carried in vessels other than microtubes.

The rotor 10 includes a generally cylindrical body portion 14 forged, cast or otherwise suitably manufactured from any suitable material. The rotor 10 is provided with a conical recess 16 (FIG. 2) by which the rotor 10 may be engaged with and driven by a suitable rotor drive arrangement (not shown) in accordance with established principles in the art.

The body portion 14 of the rotor 10 is provided with a plurality of generally radially outwardly extending arms indicated by reference characters 18A through 18J. Any predetermined number of arms 18 may project radially outwardly from the rotor body 14 consistent with various design considerations. Angularly adjacent ones of the arms 18 cooperate to form a plurality of peripheral grooves 22 disposed about the circumference of the rotor body 12 corresponding in number to the number of the arms 18. The axis 24 of each of the grooves 22 is substantially parallel to the axis of rotation CL of the rotor 10. The grooves 22 are each provided with a head space 26 (FIGS. 1 and 3) which projects radially inwardly into the body 14 of the rotor 10 for purposes described hereinafter. Although shown as semicircular in the Figures it is to be understood that the head space 26 may take any convenient form.

Each lateral face of each of the arms 18 is provided with a slot 28 which communicates with the adjacent groove 22. Thus, the slots 28A-1 and 28A-2 (FIG. 1) respectively provided on opposite faces of the arm 18A communicate with the grooves 22A and 22B, respectively. The axis of each slot 28 extends substantially parallel to the axis of rotation CL of the rotor 10. Each slot 28 has a substantially radially extending base portion 30 (FIG. 3) bounded by radially inner and radially outer wall portions 32 and 34, respectively. Each of the slots 28 has a predetermined width dimension $D_S$ measured in a substantially radial direction with respect to the rotor 10 between the inner and outer walls 32 and 34. The grooves 22, head spaces 26 and slots 28 may be provided in the rotor body by any convenient means, such as milling. The lower portion of each groove 22 is partially or fully closed, as by an annular plate 40 (FIG. 2) or the like suitably secured, as by screws, to the bottom of the rotor body 14. The plate 40 is omitted from FIG. 1 for purposes of clarity.

Figure 3:
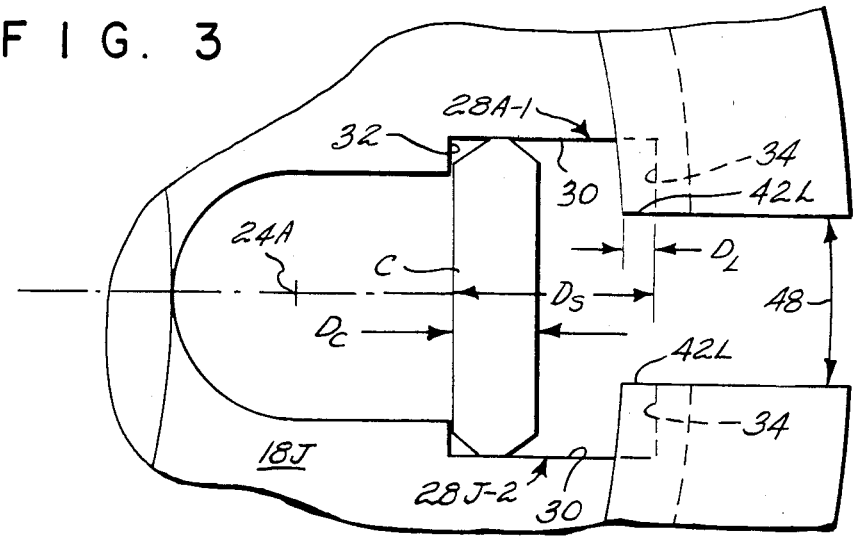
FIG. 3 is an enlarged plan view of a typical one of the grooves on the periphery of the rotor of FIG. 1 illustrating the dimensional relationship among the radial dimension of a slot, the radial distance by which a retaining member overlies the slot, and the radial thickness dimension of a tube carrier receivable in the slot.

In accordance with the present invention the retaining arrangement 12 in the preferred embodiment takes the form of a retaining lip 42 projecting upwardly from the radially outermost peripheral portions of the arms 18 of the rotor body 14. A portion 42L of the retaining lip 42 extends radially inwardly from the periphery of the rotor body 14. As best seen in FIG. 3, the portion 42L of each of the retaining lips 42 overlies the upper end, or mouth, of each of the slots 28 machined into the arms 18. The portions 42L of the retaining lips 42 overlie the outer radial portion of the slot 28 with which it is associated by a predetermined radial distance $D_L$ (FIG. 3). In the preferred case the radial distance $D_L$ by which each of the retaining lips 42 overlies the radially outer portion of each slot 28 is preferably equal. The distance $D_L$ may, of course, vary so long as the structural relationship between the slots 28 and the overhang distance of the lips 42 to be described herein is met. The undersurface of each of the lips 42 is formed such that a portion thereof lies substantially parallel to the upper surface 14U of the rotor body 14. Alternatively, the undersurface of the lip 42 may be undercut in any manner so long as a portion of the lip effectively overlays a portion of the slot 28.

In the embodiment shown in the Figures, the base 30 of each of the slots 28 does not extend in an exactly radial direction of the rotor 10. Thus, it should be understood that the term "radial distance $D_S$" as used herein denotes the distance measured in a radial direction with respect to the rotor 10 that lies between the radially inner circumferential wall 32 of the slot 28 and the radially outer circumferential wall 34 thereof.

In operation, individual tubes carrying samples of materials to be centrifuged are loaded into tube carriers C. Preferably each tube carrier C is an elongated member having a predetermined thickness dimension $D_C$ (measurable in a substantially radial direction of the rotor) associated therewith. The tube carrier C has provided therein a predetermined number of apertures A each adapted to receive and to support individual ones of the tubes T. Loaded carriers C are insertable into angularly confronting pairs of the slots 28 formed on angularly confronting lateral faces of the arms 18 which cooperate to define a groove 22. Thus, as seen in the typical example shown in FIG. 3, the slots 28A-1 and 28J-2 (respectively disposed on the arms 18A and 18J) are adapted to receive a tube carrier C in the groove 22A. The carriers C are inserted in a direction substantially parallel to the axis CL of the rotor. The circumferential clearance distance 48 between the lateral edges of angularly adjacent lips 42 is sufficient to accept the projecting portions of the tubes T carried in the carrier C as the carrier is inserted into the rotor 10. The lower end of the tube carrier C is supported against the bottom plate 40 while the opposite lateral edges of the tube carrier C are edgewise confined by each of the respective slots 28 which communicate with the groove which receives the carrier. The heads of the tubes T projecting from the tube carrier C are accommodated in the headspaces 26 formed in the rotor.

It should be understood that the tube carrier C may have alternate configurations adapted to support tubes received therein over greater or lesser portions of their length than is afforded by the carrier heretofore discussed. However, such carriers will, in all events, have flanged portions which are insertable into the cooperating confronting slots 28. It should be understood, therefore, that the dimension $D_C$ hereinabove used to denote the thickness of the carrier C shown in FIG. 3 will, in the appropriate case, also apply to the thickness dimension (measurable in a substantially radial direction of the rotor) of those portions of the carrier C which are inserted into and received and supported by the slots 28.

In accordance with the present invention, the radial dimension $D_S$ of each slot 28 is greater than the sum of (1) the radial distance $D_L$ that the lip 46 associated with the slot 28 overlies that slot plus (2) the radial thickness dimension $D_C$ of the tube carrier C which is edgewise supported in that slot 28.

Figure 4:
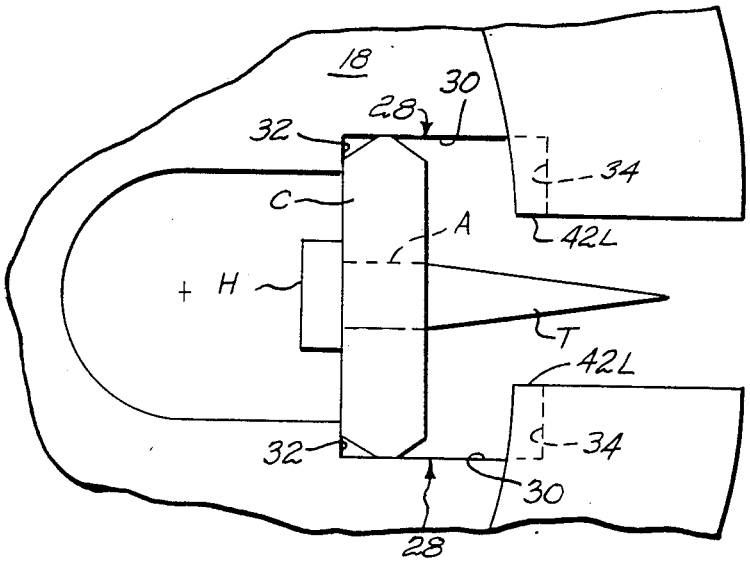
FIGS. 4 and 5 are views similar to FIG. 3, illustrating a tube carrier in a radially inner and a radially outer position within the slots communicating with a groove.
Figure 5:
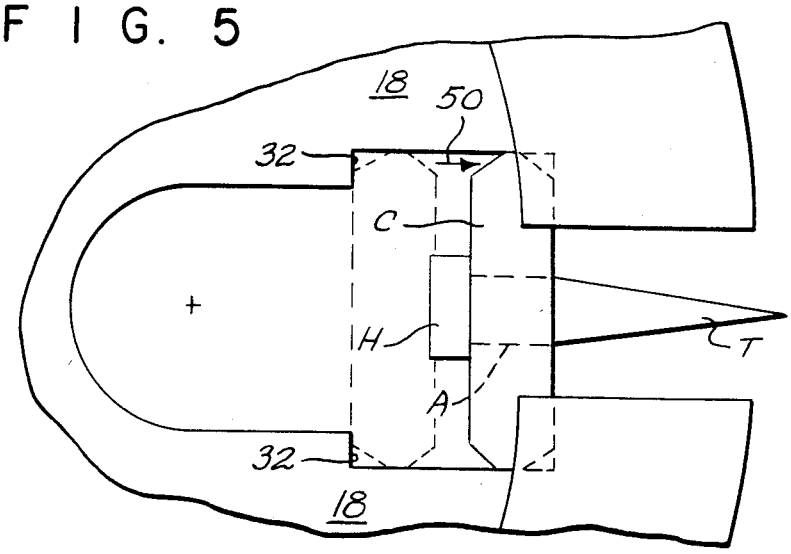

As a consequence of the structural relationship hereinabove described, the slots 28 are arranged such that a tube carrier C receivable therein is movable within the cooperating slots in response to a centrifugal force from a first, radially inner, position (FIG. 4) to a second, radially outer, position (FIG. 5). When subjected to a centrifugal force the radial outer surface of the tube carrier C moves in the direction of arrow 50 into abutting contact with the radially outer wall 34 of the slot 28 in which the carrier is edgewise supported. In such a position, the carrier C lies beneath the retaining lip 42L portion overhanging the mouth of that slot. The undersurface of the lip portion 42L of the retaining member 42 is thus presented as an abutment or barrier to prohibit motion of the tube carrier C in the slot in a direction parallel to the axis CL of the rotor. Thus, the tube carrier C is effectively prohibited from exiting the slot.

It may be appreciated that there has been described an arrangement in the form of an overhanging retaining member disposed over one or preferably both slots formed into confronting surfaces of rotor arms and arranged such that a tube carrier disposed in the slot will be effectively prohibited from exiting the slot while the rotor is spinning. Those skilled in the art, in view of the foregoing teachings, may effect numerous modifications thereto. These modifications are, however, to be construed as lying within the scope of the present invention as defined by the appended claims.

What is claimed is:

1. In a centrifuge rotor of the type having a body with arms cooperating to form in the rotor a peripheral groove the axis of which is substantially parallel to the axis of rotation of the rotor, the confronting face of each arm having a slot therein, each slot having a predetermined dimension measured in a substantially radial direction with respect to the rotor, the slots cooperating to receive a tube carrier and support the same in edgewise relationship, the tube carrier having a predetermined thickness dimension measurable in a substantially radial direction of the rotor when the carrier is supported in the slots, wherein the improvement comprises a retaining member disposed on the rotor, a predetermined portion of the retaining member overlying at least one of the slots for a predetermined distance measured in a substantially radial direction of the rotor, the radial dimension of the one slot being greater than the sum of the radial distance by which the retaining member overlies the slot and the radial thickness dimension of the tube carrier.

2. The centrifuge rotor of claim 1 wherein the improvement is further characterized by a second retaining member on the rotor, a predetermined portion of the second retaining member overlying the other one of the slots for a predetermined distance measured in a substantially radial direction of the rotor, the radial dimension of the other slot being greater than the sum of the radial distance by which the second member overlies the slot and the radial thickness dimension of the tube carrier.

3. The rotor of claim 2 wherein the radial dimension of each slot is substantially equal and the radial distance by which each retaining member overlies the slot with which it is associated is substantially equal.

4. The rotor of claim 3 wherein each of the first and second retaining members overlies the radially outer portion of the slot with which it is associated.

5. The rotor of claim 4 wherein a portion of the undersurface of each of the retaining members is substantially parallel to the upper surface of the rotor body.

6. The rotor of claim 3 wherein a portion of the undersurfaces of each the retaining members is substantially parallel to the upper surface of the rotor body.

7. The rotor of claim 2 wherein each of the first and second retaining members overlies the radially outer portion of the slot with which it is associated.

8. The rotor of claim 5 wherein a portion of the undersurface of each of the retaining members is substantially parallel to the upper surface of the rotor body.

9. The rotor of claim 2 wherein a portion of the undersurfaces of each of the retaining members is substantially parallel to the upper surface of the rotor body.

10. The rotor of claim 1 wherein the retaining member overlies the radially outer portion of the slot with which it is associated.

11. The rotor of claim 6 wherein a portion of the undersurface of the retaining member is substantially parallel to the upper surface of the rotor body.

12. The rotor of claim 1 wherein a portion of the undersurface of the retaining member is substantially parallel to the upper surface of the rotor body.

13. A centrifuge rotor of the type having a peripheral groove, the axis of which extends parallel to the axis of rotation of the rotor and confronting slots communicating with the groove, wherein the improvement comprises a retaining member a predetermined portion of which overlies one of the slots for a predetermined radial distance, the slots being sized to edgewise receive a tube carrier therein such that the tube carrier is movable within the slots in response to centrifugal force from a first, radially inner, position to a second, radially outer position in which a portion of the tube carrier lies beneath the retaining member whereby movement of the tube carrier in the slots in a direction parallel to the axis of the rotor is prohibited by the retaining member.

14. The rotor of claim 13 wherein the improvement further comprises a second retaining member a predetermined portion of which overlies the other of the slots for a predetermined radial distance such that a portion of the tube carrier, when in the second, radially outer, position lies beneath the second retaining member whereby movement of the tube carrier on the slots in a direction parallel to the axis of the rotor is prohibited by the second retaining member.

15. The rotor of claim 14 wherein a portion of the undersurfaces of each of the retaining members is substantially parallel to the upper surface of the rotor body.

16. The rotor of claim 13 wherein a portion of the undersurface of each of the retaining member is substantially parallel to the upper surface of the rotor body.

* * * * *